United States Patent [19]

Sendzimir et al.

[11] Patent Number: 4,843,673

[45] Date of Patent: Jul. 4, 1989

[54] STRIP WIPING SYSTEM

[75] Inventors: Michael G. Sendzimir, Woodbury; John W. Turley, Oxford, both of Conn.

[73] Assignee: T. Sendzimir, Inc., Conn.

[21] Appl. No.: 170,272

[22] Filed: May 17, 1988

Related U.S. Application Data

[63] Continuation-in-part of Ser. No. 64,850, Jun. 22, 1987.

[51] Int. Cl.[4] ..... B21B 45/02

[52] U.S. Cl. ..... 15/102; 15/3; 29/81 A; 72/163; 100/153; 100/171

[58] Field of Search ..... 15/3, 4, 102; 72/40, 72/163, 238, 242, 243; 100/171, 176, 153; 29/81 A; 226/187, 190, 194, 152; 34/9, 95, 152

[56] References Cited

U.S. PATENT DOCUMENTS 1,776,436 9/1930 Iversen ..... 72/243

3,020,624 2/1962 Menster ..... 72/40 X 3,429,166 2/1969 Baker et al. ..... 72/242

4,551,878 11/1985 Turley et al. ..... 15/3 X

*Primary Examiner*—Harvey C. Hornsby

*Assistant Examiner*—Scott J. Haugland

[57] ABSTRACT

A device for wiping liquids from the surface of moving metal strip under tension, such as strip produced by cold rolling mills. The device consists of a plurality of rollers, between which the strip passes, where each roller is supported by a plurality of pairs of casters. The caster pairs are spring mounted in a pair of frames, the frames being urged together by fluid powered cylinders, so that the rollers are held against the strip surfaces under pressure, thus wiping the strip surface by preventing passage of liquid on the strip surface past the rollers. The casters are arranged so that the number of rollers can be changed by shifting and removing or adding rollers. In one embodiment, the device can be converted between three and four roller arrangements.

1 Claim, 7 Drawing Sheets

STRIP WIPING SYSTEM

This is a continuation-in-part of application Ser. No. 064,850 filed June 22, 1987.

BACKGROUND OF THE INVENTION

This invention relates to wiping devices for metal strip, particularly those using three small diameter metal rollers to wipe surplus coolant from the surfaces of strip emerging from a rolling mill, when each metal roller is supported by a plurality of pairs of support rollers, such as those disclosed in our U.S. Pat. No. 4,551,878.

We have found that this method of wiping the strip has been very successful, and there are now several installations in operation. However, it has been established that when the strip tension is very low, which occurs when very light gauge strip is being rolled, this three roller wiping arrangement becomes inefficient because the tension is insufficient to generate high pressure between wiper rollers and the strip. The result of this is that the strip wraps around each roller, and a hydrodynamic oil film develops between each roller and the strip. This film remains on the strip as the strip leaves the strip wiper, thus greatly diminishing the effectiveness of the wiping action.

The present invention overcomes this deficiency, in one embodiment, by providing for the removal of the two upper wiper rollers, together with their bearings and chocks, and replacing them with a single upper wiper roller, mounted vertically in line with the existing lower wiper roller. The invention also includes splash prevention means to prevent oil from splashing over the top of the upper wiper roller.

In another embodiment, for wiping light gauge strip only, the present invention consists of a 2-roller wiper arrangement, with a single upper wiper roller mounted vertically in line with a single lower wiper roller.

In yet another embodiment two set of support bearings are provided at the bottom, enabling either a single roller to be located centrally to provide a three roller wiping mode, or two rollers to be provided at the bottom vertically in line with the two upper rollers, thus providing two separate pairs of two roller wipers within the structure, i.e. a double two roller wiper arrangement.

DESCRIPTION OF THE INVENTION

Figure 1:
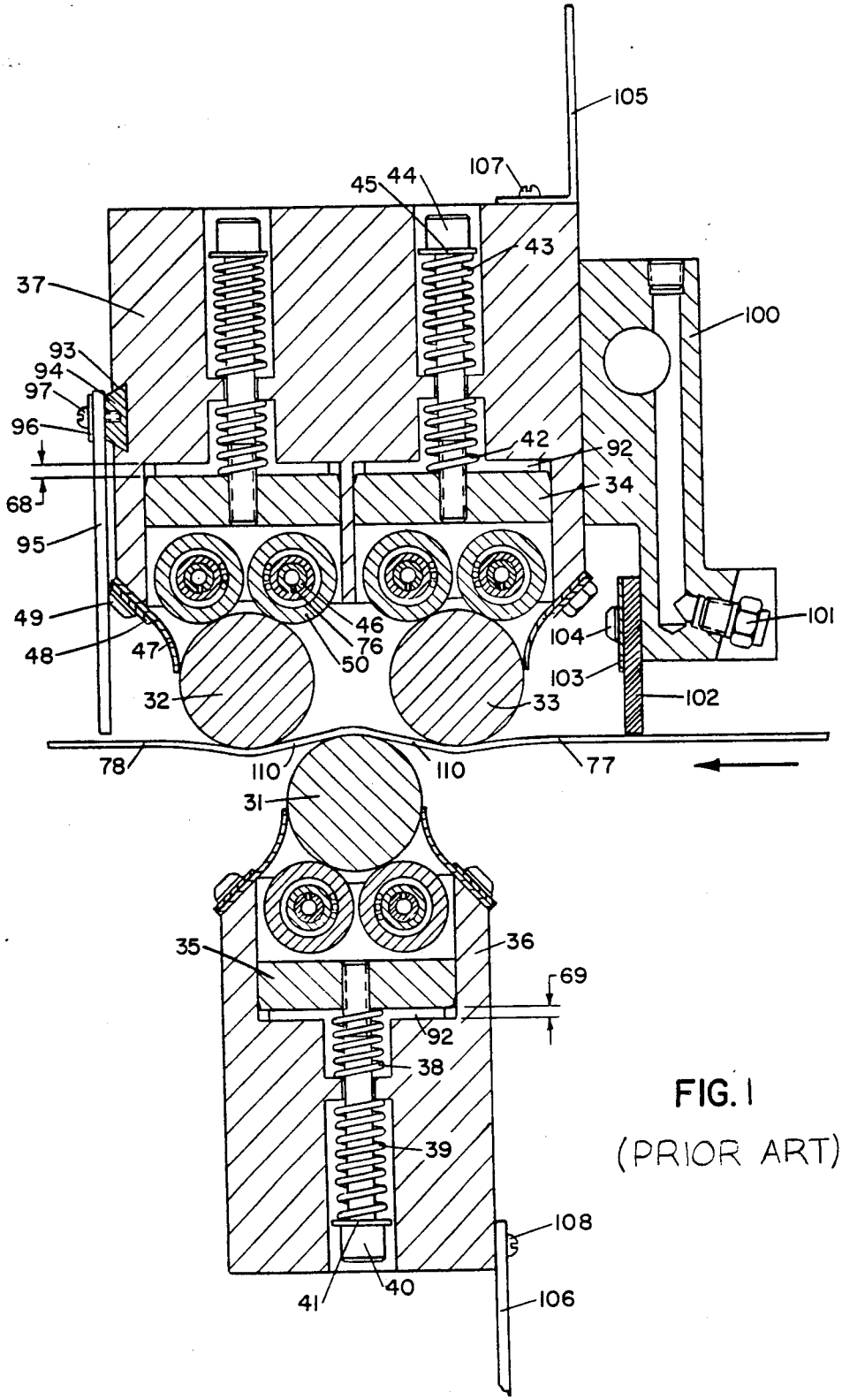
FIG. 1 (PRIOR ART)
FIG. 1 is a sectional view of a three roller wiper arrangement according to the prior art.
Figure 2:
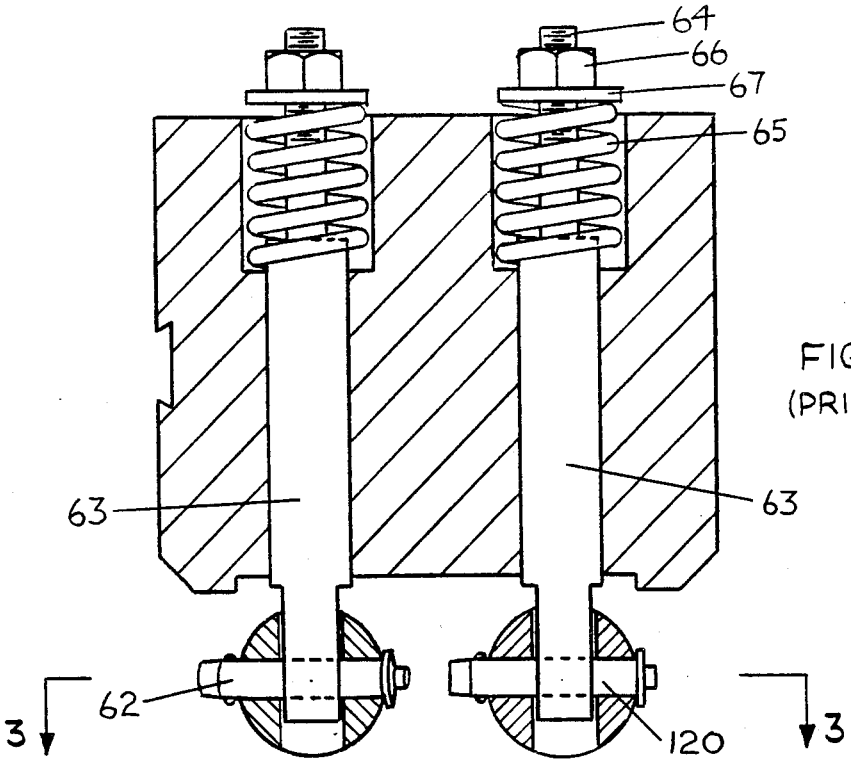
FIG. 2 (PRIOR ART)
FIG. 2 is partial sectional view showing the suspension method for the upper rollers of the arrangement of FIG. 1.
Figure 3:
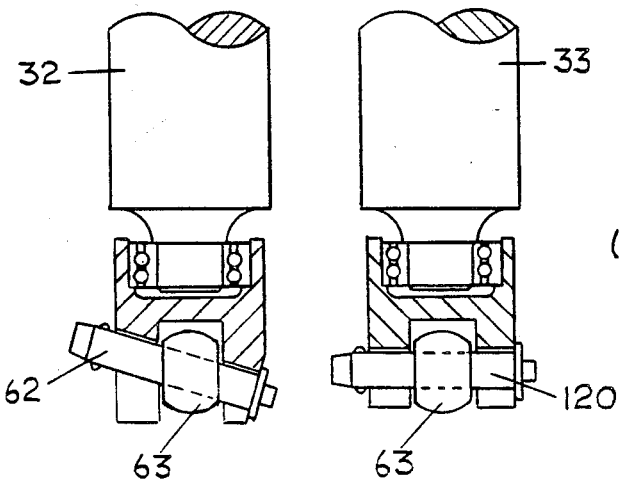
FIG. 3 (PRIOR ART)
FIG. 3 is a sectional view taken along line 3—3 of FIG. 2.

In the preferred construction of the prior art strip wipers, FIG. 1, which is more fully described in our U.S. Pat. No. 4,551,878 each upper wiper roller 32 or 33 is supported against wiping forces by several pairs of casters 50, each pair being mounted on a carrier 34 which in turn is supported by springs 42 and 43. The weight of each roller 32 or 33 shown in FIGS. 2 and 3, is supported at each end of the roller by a spring 65 acting via washer 67, nut 66, stud 64, guide rod 63, pin 62 or 120 engaging in a slot in chock 61, and roll neck bearing 60. Each roller 32 or 33 is quickly and easily removed from the assembly by opening the wipers, then retracting pin 62 or 120 by hand, and manually lifting the assemblies consisting of roller 32 or 33, bearings 60 and chocks 61 out of engagement with guide rod 63. Insertion is equally easy, being essentially the reverse of the removal procedure.

Figure 4:
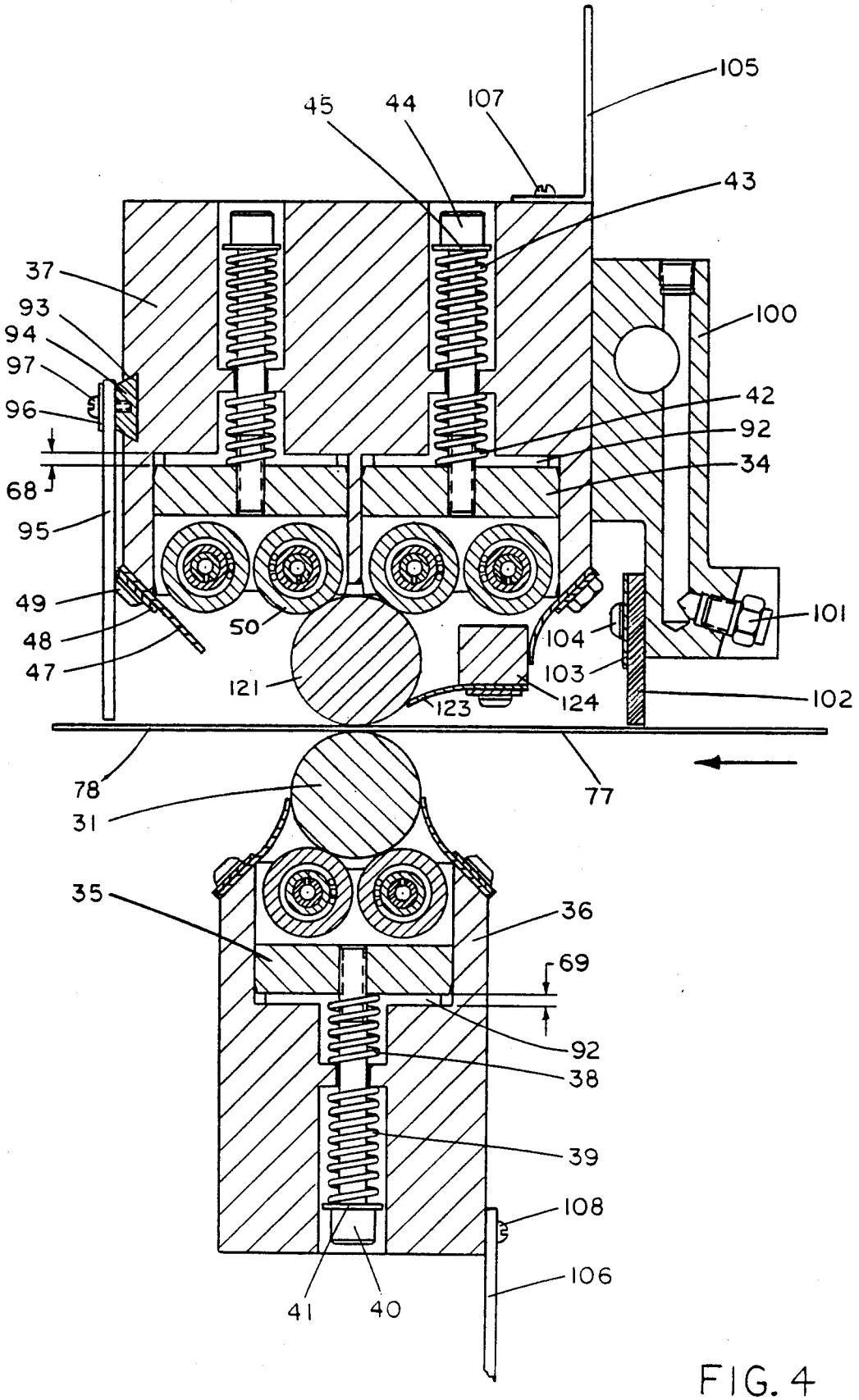
FIG. 4 is a sectional view of a two roller wiper arrangement according to one embodiment of the present invention.
Figure 5:
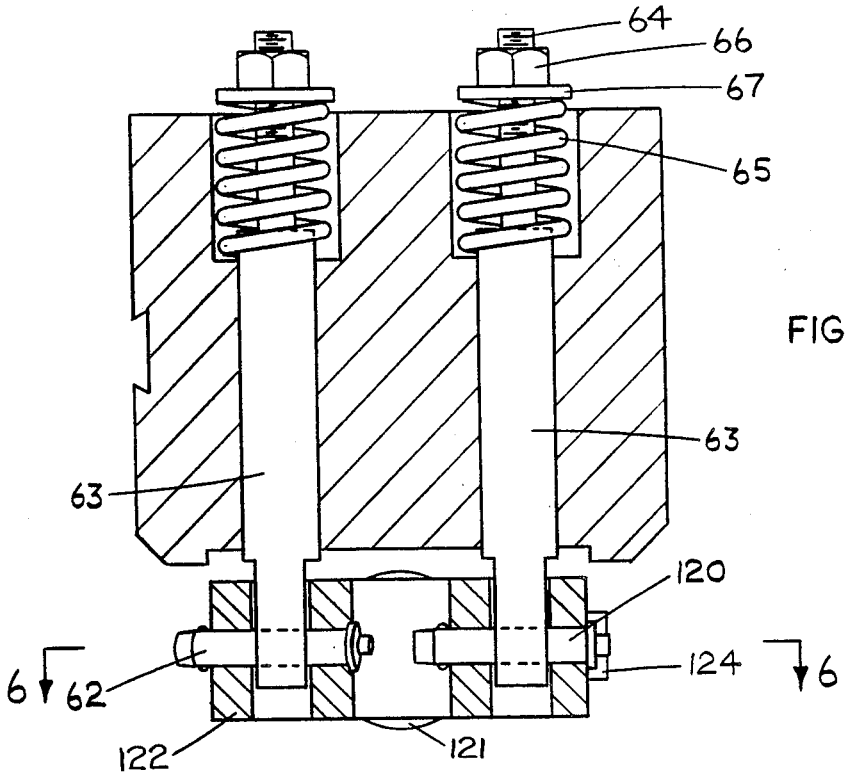
FIG. 5 is a partial sectional view showing the suspension method for the upper rollers of the embodiment of FIG. 4.
Figure 6:
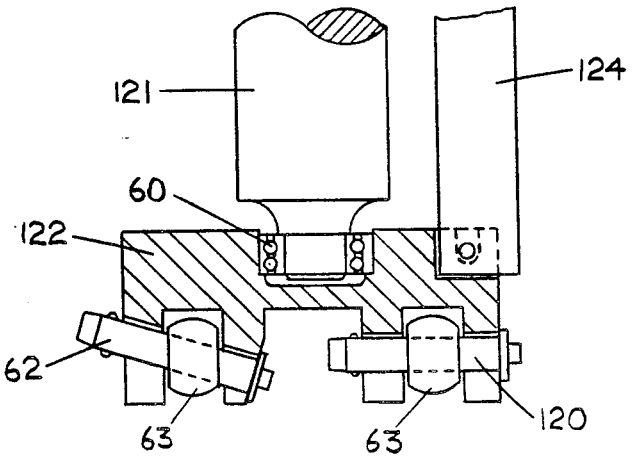
FIG. 6 is a sectional view taken along line 6—6 of FIG. 5.

In the first embodiment of our invention, FIGS. 4, 5 and 6, we envisage that, when wiping of light gauges is required, wiping devices such as those disclosed in our U.S. Pat. No. 4,551,878 can be converted to the 2-roll arrangement of the present invention by removing the upper two wiper rollers, as described above, and inserting a single upper wiper roller 121 identical to the rolls 32 and 33. Roller 121 is provided with a pair of chocks 122 within which the roller is mounted by means of bearings 60. Each chock 122 is designed to mount on the two guide rods 63, and is located on these guide rods by pins 62 and 120.

The weight of roller 121 is supported by the two springs 65 at each end, each spring 65 acting via washer 67, nut 66, stud 64, guide rod 63, pins 62 or 120, housings 122 and bearing 50. Oil is prevented from splashing over roller 121 by baffle 123 made from a suitable flexible elastomer, which is screw mounted to spacer bar 124 which bridges across the strip between the two chocks 122 between which roller 121 is mounted. Existing baffle 47 rests against spacer bar 124 to complete the seal. It can be seen that upper wiper roller 121 is supported against wiping forces by the central two sets of casters only out of the four sets of casters previously used for the 3-roll prior art configuration. After completion of wiping of light gauge strip, the upper roller 121 together with its chocks and spacer bar, can be removed and replaced by the original upper rollers 32 and 33, together with their chocks, enabling operation in the three roller mode using the configuration of our U.S. Pat. No. 4,551,878 again.

Figure 7:
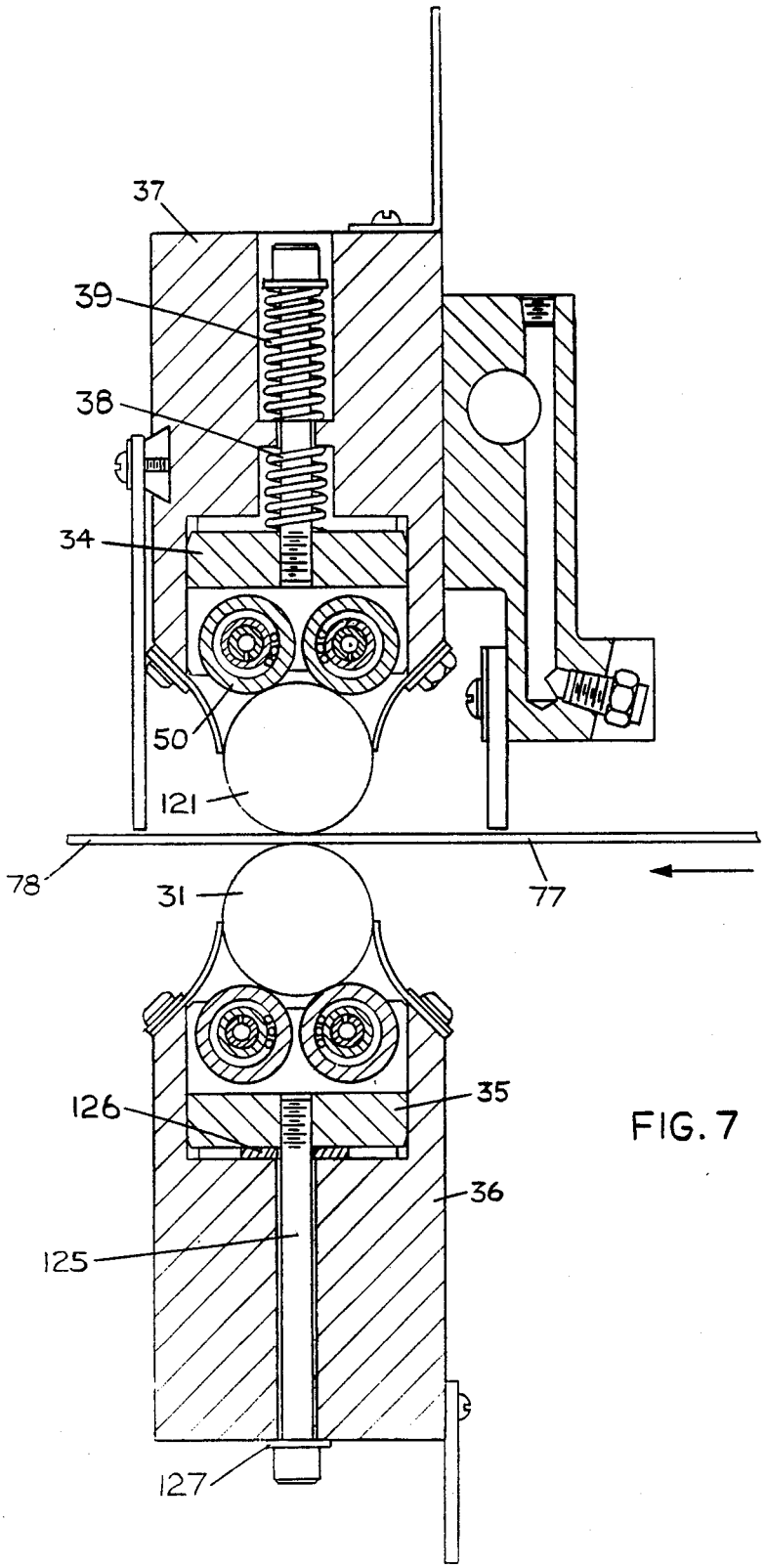
FIG. 7 is a sectional view of a two roller wiper arrangement according to a second embodiment of the present invention.

In another embodiment of our invention, FIG. 7, a 2-roller wiper arrangement is shown. This embodiment is not suitable for converting into a 3-roller arrangement, but has the advantages of lower cost and smaller size, enabling it to fit in more congested areas than the 3-roller arrangement. This embodiment is only suitable for wiping of strip less than approx. 0.01 inches thick, i.e. light gauge strip. In this embodiment, the arrangement of both upper and lower wiper roller assemblies are essentially identical to each other and to the arrangement of the lower wiper roller assembly described in our U.S. Pat. No. 4,551,878.

In this embodiment, springs 38 and 39 identical to the springs used to support the lower roller 31 in the embodiment of FIG. 4, will also be used to support the upper roller 121. Cold rolled strip typically has a crown, or center to thickness edge difference of the order of 2 or 4%. Since for light gauge strip the crown is very small and the prime function of springs 38 and 39 is to allow the respective wiper rollers to conform more readily to the crown of the strip being wiped, it is also possible, as a cost reduction means, to dispense with these springs entirely and simply use screws or other rigid attachment means to attach carriers 35 to lower frame 36, and/or carriers 34 to upper frame 37. We have shown this construction in the lower part of FIG. 7, where screws 125 and washers 126,127 are used to attach carriers 35 to lower frame 36.

Figure 8:
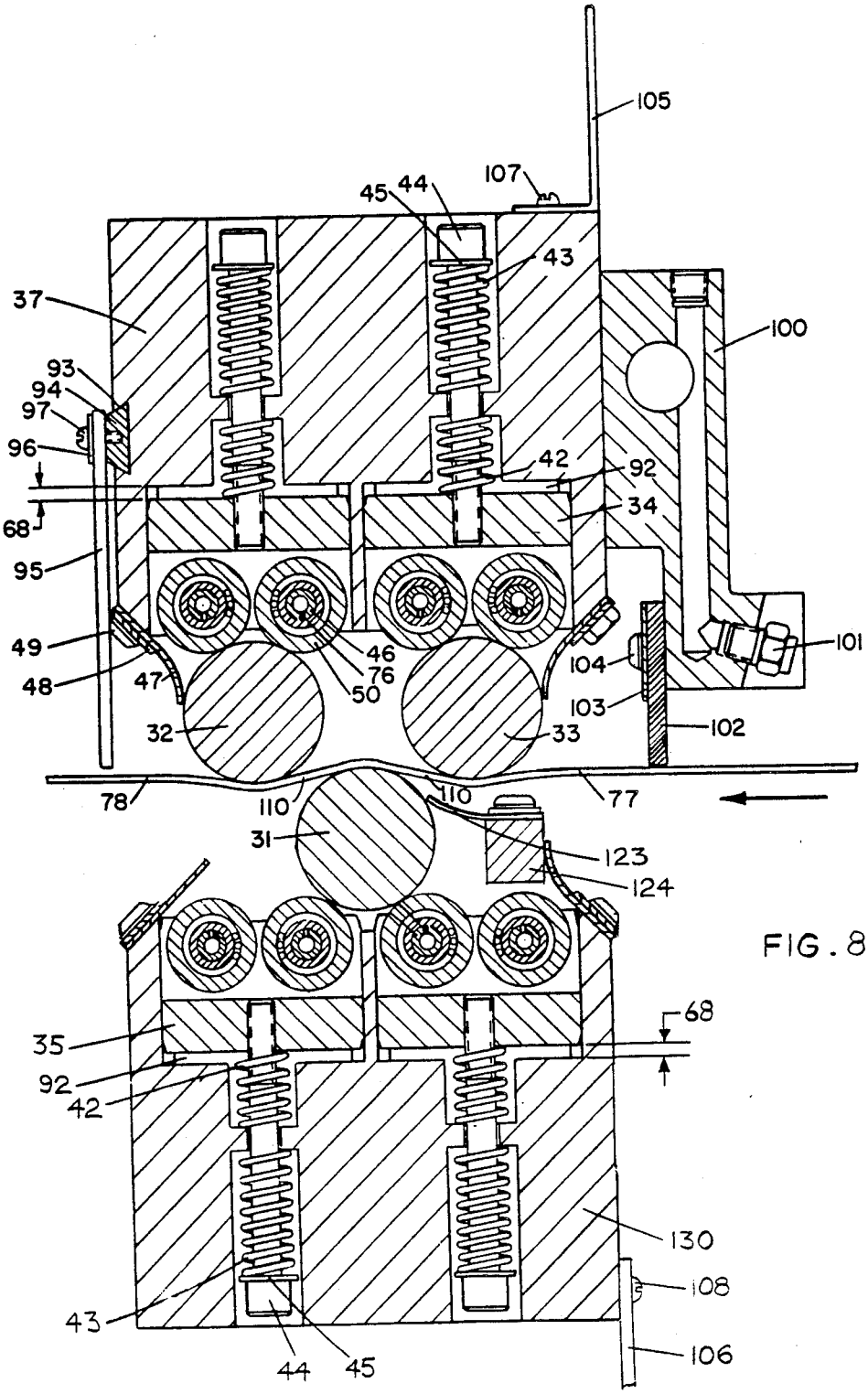
FIG. 8 is a sectional view of a three roller wiper arrangement according to a third embodiment of the present invention.
Figure 9:
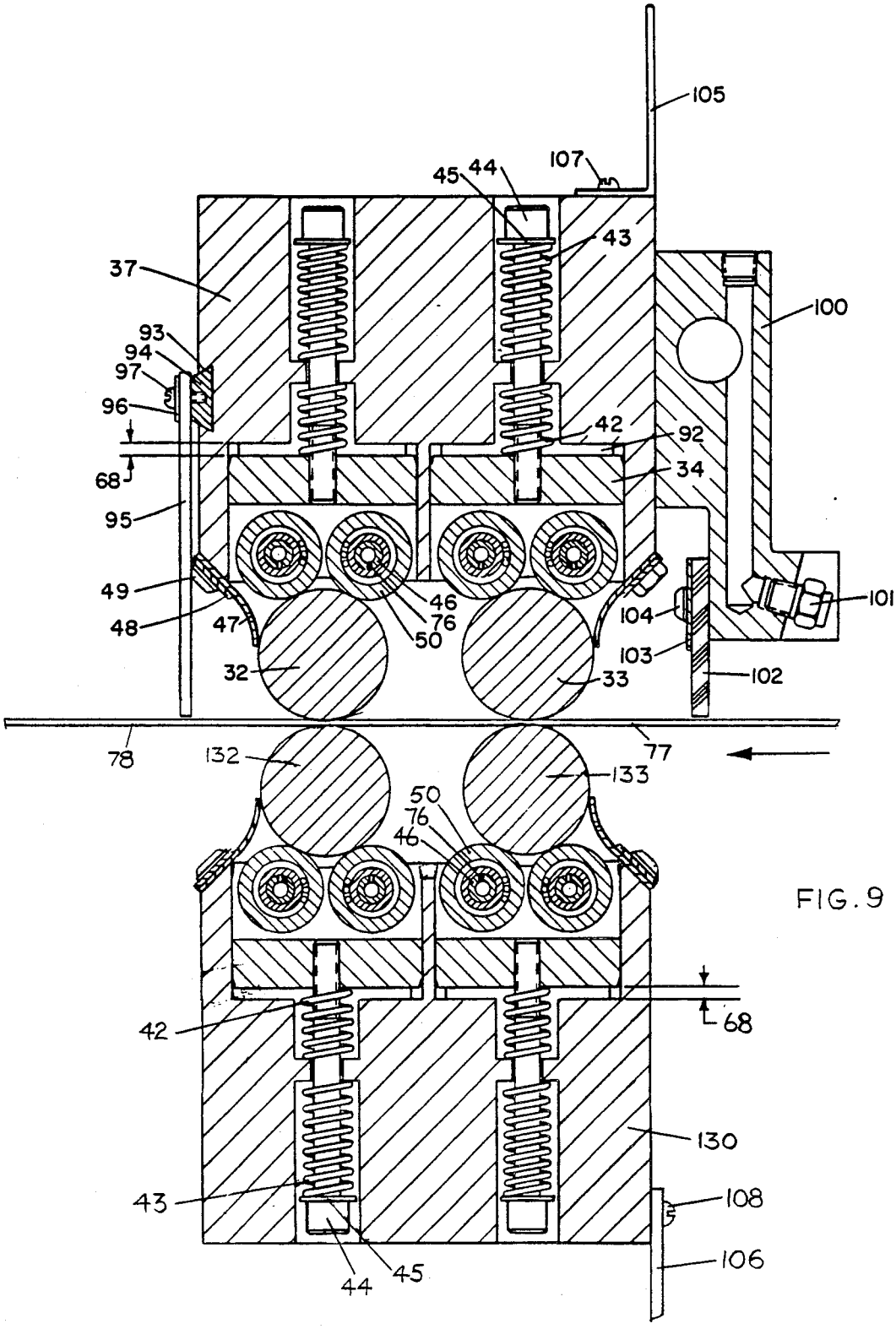
FIG. 9 is a sectional view of a double two roller wiper arrangement according to said third embodiment.

In yet another embodiment of our invention, FIGS. 8 and 9, the lower frame 36 of FIG. 1 is replaced by a new lower frame 130, which is provided with two sets of carriers 35 instead of 1 set, and four rows of casters 50 instead of two rows. Frame 130 is identical to upper frame 37 except that it has no spray assembly (parts 100–104) or edge wiper assembly (parts 93–97). Springs 42 and 43, identical to the upper springs 42 and 43, are used in the lower frame, rather than stiffer springs 38 and 39 used in the prior art lower frame 36, since there are now two sets of springs instead of 1 set.

With this embodiment it is possible to operate either in a double 2-roll wiper mode, as shown in FIG. 9, where lower rollers 132 and 133 are attached to the lower frame by the prior art method of FIGS. 2 and 3, or in a 3-roll wiper mode as shown in FIG. 8, where lower roller 31 is attached to the lower frame by the method of FIGS. 5 and 6, more fully described above. Baffle 123 mounted on spacer bar 124 is used to prevent oil from splashing under roller 31.

It should be noted that for wiping of light gauge material with a substantially uniform profile, it may be possible to eliminate springs 42 and 43 and thus achieve a cheaper construction.

The embodiments shown in the drawings and heretofore described are by way of example only, and other embodiments are possible without departing from the spirit of the invention.

I claim:

1. An improved three roller device for wiping liquids from the surface of metal strip under tension, consisting of three rollers mounted with their axes parallel to the place of the strip and to each other, and perpendicular to the direction of strip travel, two of said rollers being urged against the upper surface of the strip, and one of said rollers being urged against the lower surface of the strip and being offset from vertical alignment with each of said two rollers, two rows of casters for each roller, each roller being urged by two of said rows of casters, each of said rows consisting of a coaxial plurality of said casters, a plurality of carriers within which said casters are mounted, and upper and lower rigid frames within which said carriers are spring mounted, the improvement consisting of the provision of an additional two of said rows of casters in said lower rigid frame, arranged so that said one roller being urged against the lower surface of the strip can be replaced with a pair of rollers, each of said pair of rollers being urged against the lower surface of the strip by two of said rows of casters so that each of said pair of rollers is vertically in line respectively with one of said two rollers being urged against the upper surface of the strip, to enable a double two roller configuration to be achieved in addition to the three roller configuration.

* * * * *